US006467796B1

(12) United States Patent
Weltman et al.

(10) Patent No.: US 6,467,796 B1
(45) Date of Patent: Oct. 22, 2002

(54) SKI BINDING ASSEMBLY

(76) Inventors: Joshua Weltman, P.O. Box 1062, Driggs, ID (US) 83422; Jim Farrier, 150 Tablerock Rd., Alta, WY (US) 83422

( * ) Notice: Subject to any disclaimer, the term of this patent is extended or adjusted under 35 U.S.C. 154(b) by 0 days.

(21) Appl. No.: 09/523,035

(22) Filed: Mar. 10, 2000

(51) Int. Cl.[7] ..... A63C 9/00
(52) U.S. Cl. ..... 280/615; 280/619
(58) Field of Search ..... 280/607, 614, 280/615, 631, 619, 622, 632

(56) References Cited

U.S. PATENT DOCUMENTS

| | | | | | |
|---|---|---|---|---|---|
| 2,172,669 | A | * | 9/1939 | Taft | 280/614 |
| 3,907,319 | A | | 9/1975 | Berlied, Jr. | |
| 3,921,996 | A | | 11/1975 | With | |
| 3,985,371 | A | | 10/1976 | Pyzel et al. | |
| 4,062,134 | A | * | 12/1977 | Ryder | 280/615 |
| 4,153,271 | A | | 5/1979 | Biittner | |
| 4,186,500 | A | * | 2/1980 | Salzman | 280/615 |
| 4,191,396 | A | * | 3/1980 | Biermann et al. | 280/615 |
| 4,309,834 | A | * | 1/1982 | Bente | 280/615 |
| 4,312,141 | A | * | 1/1982 | Mayer et al. | 280/615 |
| 4,322,092 | A | | 3/1982 | Feucht et al. | |
| 4,365,821 | A | * | 12/1982 | Dreyenbuhl | 280/615 |
| 4,410,199 | A | * | 10/1983 | Eisenberg | 280/615 |
| 4,514,916 | A | | 5/1985 | Aarflot | |
| 4,610,459 | A | * | 9/1986 | Jungkind | 280/615 |
| 4,768,805 | A | | 9/1988 | Graillat | |
| 4,993,742 | A | | 2/1991 | Wittmann et al. | |
| 5,007,656 | A | | 4/1991 | Girault et al. | |
| 5,044,655 | A | | 9/1991 | Garau | |
| 5,052,710 | A | | 10/1991 | Provence et al. | |
| 5,066,036 | A | * | 11/1991 | Broughton | 280/615 |
| 5,228,715 | A | | 7/1993 | Sedlmair | |
| 5,518,264 | A | * | 5/1996 | Broughton | 280/615 |
| 5,669,622 | A | | 9/1997 | Miller | |

FOREIGN PATENT DOCUMENTS

| | | | | |
|---|---|---|---|---|
| CH | 358020 | | 12/1961 | |
| CH | 622432 | * | 4/1981 | 280/615 |
| DE | 583103 | * | 5/1932 | 280/619 |
| DE | 2430346 | | 1/1975 | |
| DE | 2731561 | | 1/1978 | |
| DE | 2639167 | | 3/1978 | |
| DE | 2707626 | * | 8/1978 | 280/615 |
| DE | 2831940 | | 5/1979 | |
| DE | 2929834 | | 2/1981 | |
| FR | 1288614 | * | 2/1962 | 280/619 |
| SE | 89860 | * | 7/1937 | 280/615 |

* cited by examiner

*Primary Examiner*—Douglas Hess
*Assistant Examiner*—Elaine Gort
(74) *Attorney, Agent, or Firm*—Lewis, Rice & Fingersh, L.C.

(57) ABSTRACT

The present invention provides a ski binding assembly comprising a toe member and heel member affixed to a ski. The ski binding assembly further comprises a ski boot having a sole extension with through-holes formed therethrough. The assembly also provides a latch mechanism adapted to both engage the through-holes in the ski boot as well as clear snow and other debris which has collected within the throughholes. In another aspect of the invention, the toe member has openings which allow snow collected therein to be expelled as the ski boot is inserted into the toe member. Finally, the heel member is adapted to support the ski boot while reducing the overall weight of the ski binding assembly.

22 Claims, 8 Drawing Sheets

SKI BINDING ASSEMBLY

BACKGROUND

1. Field of the Invention

The present invention relates to ski binding assemblies, and more particularly to ski binding assemblies having a toe member and a heel member arrangement adapted to secure and support a ski boot.

2. Prior Art

Those skilled in the art can best appreciate that there are generally three types of skiing: alpine or downhill, cross-country or touring, and telemark or backcountry. Each type of skiing is performed in a significantly different manner which has resulted in the development of distinctly different equipment. For instance, in downhill skiing a skier descends down a steep slope at a high rate of speed while executing certain downhill maneuvers. To withstand the forces created during downhill skiing, the equipment must be comparatively robust. As such, the skis are often manufactured with metal edges while the ski boots are rigid and sturdy in order to withstand the rigors of downhill skiing. To attach the ski boots to the skis, a binding is fastened to the ski which secures both the heel and the toe of the ski boot to the ski, thus enhancing the rigidity and overall responsiveness of the connection between the ski boot and ski.

On the other end of the spectrum, cross-country skiing requires a skier to traverse typically level fields by performing a walking or skating motion. Since cross-country skiing is substantially slower, the stresses exerted upon cross-country equipment is far less than that exerted upon downhill skiing equipment, therefore there is no need for the equipment to be as robust as downhill equipment. Instead, the weight and flexibility of the equipment becomes critical. As such, the skis do not typically have metal edges and the boots are often lightweight and more shoe-like. Reducing the weight of the equipment enhances performance since the cross-country skier propels himself over generally level surfaces. The equipment must be flexible to allow the skier to perform the various walking or gliding motions required of a cross-country skier. For instance, in order to perform either motion, the cross-country skier must be able to easily raise his ski boot heel from the surface of the ski, thus cross-country bindings typically secure only the toe portion of the ski boot to the ski while the soles of the ski boots are pliant.

A hybrid between downhill skiing and cross-country skiing is telemark skiing. Telemark skiing often involves traversing unpredictable backcountry terrains. In some instances, the terrain may be similar to a downhill slope and in other instances the terrain may be similar to a level cross-country field or anything in between. The equipment used in telemark skiing must therefore be sufficiently rigid in order to provide adequate responsiveness as in downhill skiing while also being sufficiently flexible and lightweight to allow for cross-country touring.

A variety of different ski binding assemblies have been suggested in the art which could be used in telemark skiing in order to interconnect a ski boot to a ski. One such prior art device is disclosed in U.S. Pat. No. 3,907,319 to Bearlide, Jr. entitled "Toepiece for Cross-Country Skiing." The toepiece disclosed by Bearlide includes a base plate attached to the surface of the ski and a pair of side walls which extend upwardly from the base plate. The base plate has three pins that extend upwardly, while the sole includes three corresponding recesses that terminate within the sole of the ski boot. To couple the ski boot to the ski, the skier first slides the ski boot forward until the recesses in the boot are aligned with the pins of the toepiece. Once the pins are inserted into the recesses, a clamp is lowered over the ski boot to secure it to the ski.

Although three-pin bindings may adequately secure a ski boot to a ski, these bindings also have several disadvantages. As the ski boot is coupled to the ski, the pins are concealed by the ski boot. Therefore, the user may be required to expend substantial time and energy while trying to align the recesses with the pins. In addition, snow and other debris tends to collect on the base plate and becomes compacted about the pins, thus concealing their location. The skier must then expend even more time and effort to chisel this debris from around the pins or from within the recesses before securing the ski boot to the ski.

Other types of ski binding assemblies are well known in the art such as cable bindings. These bindings may be used either alone or in conjunction with a three-pin bindings. One reference which discloses a cable binding representative of the art is U.S. Pa. No. 5,669,622 to Miller entitled "Ski Binding." This ski binding assembly includes a ski boot having a heel portion with a slot or groove formed thereabout and a toe piece having a pair of side walls. A cable is then fitted into the slot or groove formed about the heel of the ski boot and tensioned in order to secure the ski boot to the ski. This reference also discloses a spacer which has a curved rear edge and a hollow formed thereabout which is designed to hold and store the cable when not secured to the heel of the ski boot.

Cable bindings have been found to have several drawbacks. For instance, they tend to be less reliable and break over time. In fact, this occurrence is so acute that many telemark skiers often carry spare cables. Further, these cable bindings secure the ski boot to the ski by drawing the boot forward against the toe piece. Over time the sides of the boot begin to deform inwardly resulting in a loose connection between the ski boot and the ski. As such, the cable needs to be tightened over time as the boot creeps deeper into the toe piece. In the event the cable binding is used in combination with a three-pin binding, the forward force exerted by the cable on the boot causes the pins to bear against and elongate the holes. Aside from these general drawbacks inherent in cable bindings, the spacer disclosed by Miller has an additional drawback. Spacers manufactured in accordance with Miller are capable of providing sufficient support to the heel of the ski boot while also serving as a receptacle for receiving the cable when not secured to the heel of the ski boot. However, these spacers are typically quite large and result in a corresponding increase in the overall weight of the ski binding assembly which is undesirable.

Another type of ski binding assembly which has been suggested in the context of cross-country skiing is disclosed in U.S. Pat. No. 4,004,823 to Pyzel, et al. entitled "Touring Ski Boot Binding." The ski boot binding assembly described in this reference discloses a ski boot having an L-shaped element which extends from the forward portion of the sole and an L-shaped element attached to the ski which may be biased to releasably engage the L-shaped element on the ski boot.

Although the ski boot binding assembly disclosed in Pyzel et al. is structurally different than the three-pin binding assemblies and cable binding assemblies previously discussed, it has many of the same drawbacks. As with three-pin bindings, the L-shaped elements are prone to snow collection during use, thereby frustrating simple and quick interconnection between the L-shaped element on the ski boot and the L-shaped element on the ski. Further, this reference does not suggest any mechanism which facilitates the proper alignment of the ski boot with the ski binding. Another disadvantage with this binding is that the attachment mechanism extends from the forward portion of the sole which is prone to being inadvertently impacted or damaged during use.

Still another device known in the art to secure a ski boot to a ski is disclosed in U.S. Pat. No. 4,322,092 to Feucht, et al., entitled "Cross-County Ski Binding." This ski binding assembly includes a ski boot which has a projection with a pair of slots and a pair of openings that extend from the forward portion of the boot's sole. The ski binding also includes a pair of pins that correspond to the slots on the ski boot and a hooked member which is releasably biased to grasp and draw the projection, and thus the ski boot, into engagement with the ski binding assembly.

As with the prior references, even this ski binding assembly is prone to snow and debris collection which may frustrate the ability of the skier to simply and efficiently secure the ski boot to the ski. Once snow or debris collects about the projection, it will become difficult for the skier to hook the projection with the hooked member. Another drawback to this type of ski binding assembly is that for the ski boot to be properly aligned with the ski binding requires the pins to be properly registered with the slots of the projection. In this design, the hooked member is permitted to move about the projection permitting frictional wear between the hooked member and the projection. Once again, in a snowy environment, it may be difficult to locate and align the pins with the slots.

Therefore, there is a need in the art for a ski binding assembly that provides a toe member which allows the ski boot to be simply and reliably connected to the ski while minimizing the adverse effects that may be caused by snow or other debris which may become collected on the ski binding assembly, ski or ski boot. It would also be desirable to have a ski binding assembly which provides the skier with enhanced visualization and alignment of the ski boot within the toe member. In addition, it would be desirable to have a ski binding assembly that enhances the versatility of such devices by providing both a cable-type binding and a pin-type binding each of which may be used either alone or in conjunction with one another. Finally, it would be desirable to have a ski binding assembly having minimal overall weight which provides a responsive rigid connection between the ski boot and ski while also providing sufficient flexibility.

SUMMARY OF THE INVENTION

In brief summary, the present invention overcomes and substantially alleviates the deficiencies in the prior art by providing a ski binding assembly having a toe member for securing a ski boot to a ski with both a cable-type binding and a pin-type binding as well as a heel member for supporting the heel of a ski boot while minimizing the overall weight of the assembly.

One embodiment of the ski binding assembly includes a toe member and a heel member attached to a ski. The toe member and the heel member interface with a ski boot to support and secure the ski boot to the ski. The toe member comprises a base plate attached to a ski and a pair of side walls formed adjacent the base plate. The base plate is uniquely configured to minimize the collection of snow and other debris since the base plate is formed to have a substantially planar surface free from surface features. By removing surface features such as pins and the like from the surface of the base plate, snow and debris may be easily ejected from the surface. To further minimize the collection of snow and debris, the base plate is preferably formed from stainless steel. However, the present invention also contemplates constructing the base plate from a variety of other suitable materials. Although the surface is free from surface features, in an alternative embodiment, the surface may be textured or knurled to enhance traction between the ski boot and base plate.

Attached between the side walls is a top plate having at least one aperture. The toe member also includes a front plate located between the top plate and the base plate defining a pair of openings therebetween. These openings allow for debris and snow which has collected on the base plate to be ejected as the ski boot is inserted into toe member. The front plate defines a stop surface within the toe member. As the ski boot is slid into the toe member it abuts both the stop surface of the front plate along with the side walls to provide a reliable indication to the skier when the ski boot is properly aligned within the toe member while also preventing wear to the ski boot. The toe member is secured to the ski by screws that are inserted into screw holes formed through the base plate.

In addition to a novel toe member, the present invention also has a novel ski boot defined by a sole and an upper. The sole comprises a heel having a slot formed thereabout and a sole extension defined by a front surface and a pair of side surfaces which are adapted to engage with the side walls of the toe member. Another novel aspect of ski boot is that it includes a top surface and a bottom surface with at least one through-hole formed through the ski boot. The through-hole includes a liner which is formed from a resilient material, such as stainless steel and the like, and is sized to engage a corresponding projection.

To secure the ski boot to the toe member, the present invention includes a disengagible latch. The disengagible latch may be moved between a disengaged position wherein the ski boot is removable from the toe member and an engaged position wherein the ski boot is secured to the toe member. The disengagible latch includes a pin which extends downwardly through the aperture in the top plate and into the through-hole of the ski boot when in the engaged position thus simultaneously expelling snow and debris from the aperture and through-hole while securing the ski boot to the ski. When in the disengaged position, the pins are disengaged from the apertures and through-holes allowing removal of the ski boot from the toe member.

The present invention also permits use of a cable binding. Specifically, the toe member includes a pair of knobs located on the side walls to which the cable is attached. The cable operates to draw the ski boot tightly against the stop surface and side walls since the forward motion of the ski boot is resisted by the stop surface and the side walls minimizing the possibility of deformation of the ski boot.

Another novel feature of the present invention is that the heel member supports the heel of the boot while its construction and configuration minimizes the overall weight of the ski binding assembly. The heel member has a body which is defined by a forward portion and an opposing rearward portion with a slot formed thereabout. The body is further defined by a pair of side portions which are inwardly scalloped to reduced its overall weight. To secure the heel member to the ski, the heel member includes openings through which a screw, or other similar securing device, is used to fasten the heel member to the ski.

In operation, a skier is provided with a responsive and versatile, yet lightweight, ski binding assembly which allows the ski boot to be easily coupled to the ski. The skier first slides the ski boot into the toe member which ejects any snow or other debris out of toe member through the openings until the front surface of the ski boot abuts the stop surface and side walls. Once so positioned, the through-hole is aligned with the aperture of the top plate. Next, the ski boot is attached to the ski by moving the disengagible latch into the engaged position. One skilled in the art can appreciate that the use of a projection which extends into the sole extension in a downward direction through the top plate and into the sole of the ski boot allows for snow or other debris which has collected within the through-hole to be expelled as the projection is inserted as well as enhance visualization of the through-hole of the boot and simplify alignment of the boot within the toe member. Since the through-hole is formed through the entire sole extension, the projection will force any snow or other debris out of the through-hole. When the skier decides to remove the ski boot from the ski, the skier simply moves the disengagible latch into the disengaged position. When it is desirable to use the cable, it may be affixed to the knobs of the toe member and then tensioned about the heel of the ski boot with the cable received within the slot formed thereabout. The cable may also be stored when it is not needed by inserting it into the slot about the heel member and tensioning it therein. As such, the skier may use the cable-type binding, the pin-type binding, or both bindings.

One object of the present invention is to provide a responsive sturdy connection between a ski boot and ski.

Another object of the present invention is to provide a ski binding assembly which reduces the overall weight of the assembly.

Still another object of the present invention is to provide a ski binding assembly which minimizes the adverse effects of snow collection by the ski binding, the ski boot or the ski itself.

Still a further object of the present invention is to simplify visualization and alignment of the boot within the toe member.

Still yet another object of the present invention is to provide a ski binding assembly which enhance the versatility of such devices by providing both a cable-type binding and a pin-type binding, each of which may be used either alone or in combination with one another.

These and other objects of the present invention are realized in the preferred embodiment of the present invention, described by way of example and not by way of limitation, which provides for a ski binding assembly having a toe member adapted to simplify the process of securing a ski boot to a ski.

Additional objects, advantages and novel features of the invention will be set forth in the description which follows, and will become apparent to those skilled in the art upon examination of the following more detailed description and drawings in which like elements of the invention are similarly numbered throughout.

DETAILED DESCRIPTION

Figure 1:
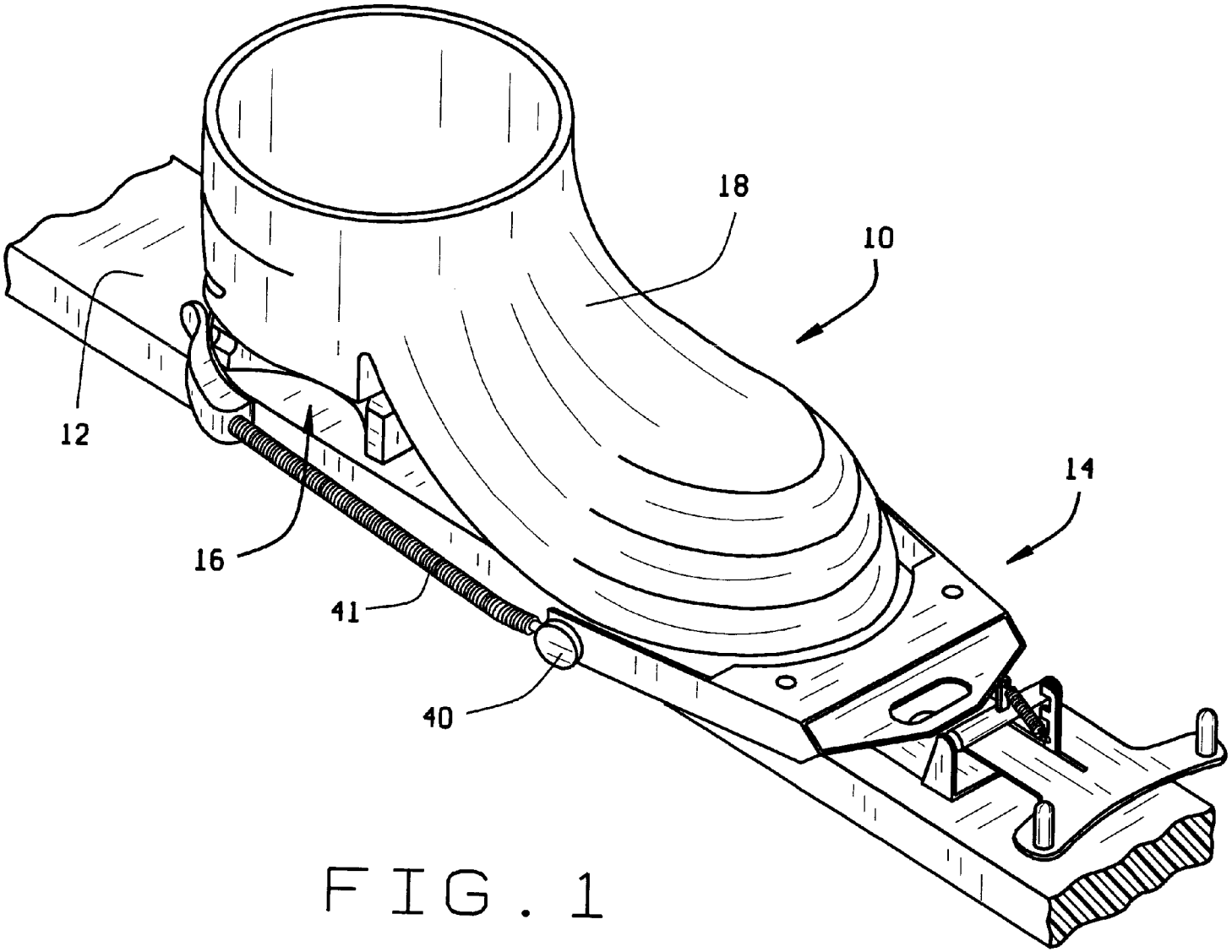
FIG. 1 is a perspective view of the ski binding assembly according to the present invention.

Referring to the drawings, the preferred embodiment of the ski binding assembly of the present invention is illustrated and generally indicated as 10 in FIG. 1. The ski binding assembly 10 includes a toe member 14 and a heel member 16 attached to a ski 12. The toe member 14 and heel member 16 interface with a ski boot 18 to support and secure ski boot 18.

Figure 2:
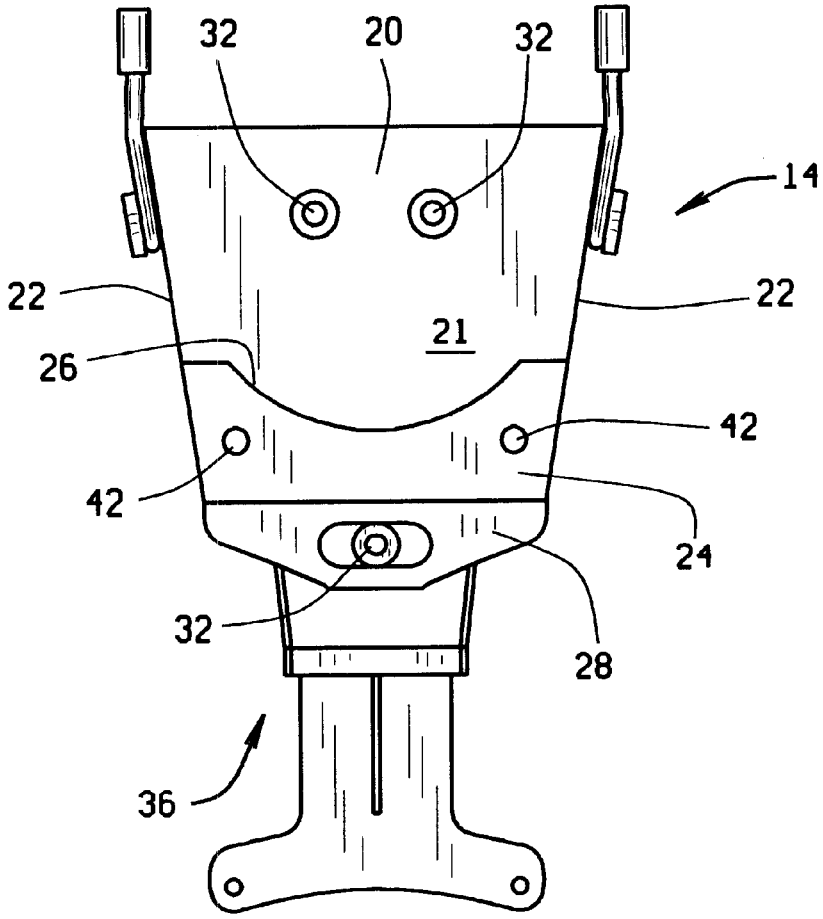
FIG. 2 is a top plan view of toe member of the ski binding assembly according to the present invention.

As shown in FIG. 2, toe member 14 includes a base plate 20 bounded by a pair of side walls 22. Preferably, base plate 20 is uniquely configured to minimize the collection of snow and other debris since base plate 20 is formed having a substantially planar surface 21 substantially free from surface features. By removing surface features, such as pins and the like, from surface 21, snow and other debris may be easily ejected therefrom. To further minimize the collection of snow and debris, base plate 20 is preferably formed from stainless steel; however, any suitable material which provides a substantially smooth surface 21 may be utilized without departing from the spirit and scope of this invention. In fact, the present invention contemplates constructing base plate 20 from a variety of other materials which may then be coated with a plastic, rubber or other similar material. Although surface 21 is preferably free from surface features, in an alternative embodiment, the surface may be textured or knurled (not shown) to enhance traction between ski boot 18 and base plate 20.

Attached between the side walls 22 is a top plate 24 having a rounded edge 26 that provides sufficient clearance to allow insertion of the forward portion of ski boot 18 into toe member 14 and has apertures 42 formed herethrough.

Figure 3:
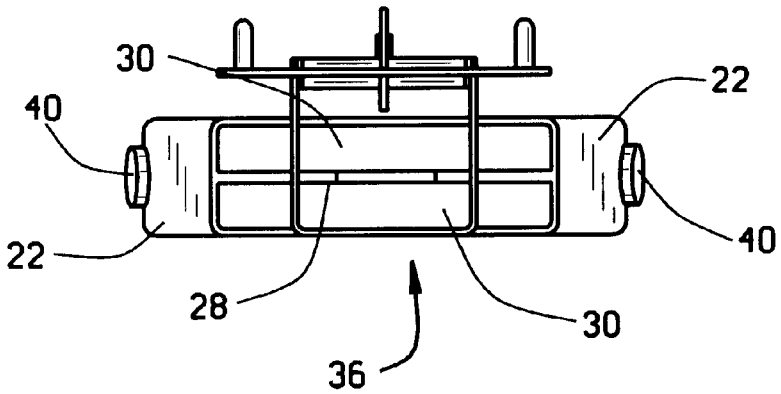
FIG. 3 is a front elevational view of toe member according to the present invention.

Toe member 14 further includes a front plate 28 located between top plate 24 and base plate 20 which defines pair of openings 30, as illustrated in FIG. 3. Openings 30 allow for debris and snow which has collected on base plate 20 to be ejected as ski boot 18 is inserted into toe member 14. Toe member 14 is secured to the ski 12 by screws (not shown) that are inserted through screw holes 32 formed in base plate 20. However, one skilled in the art can best appreciate that a variety of other attachment mechanisms may be utilized without departing form the novel aspects of the present invention.

Figure 4:
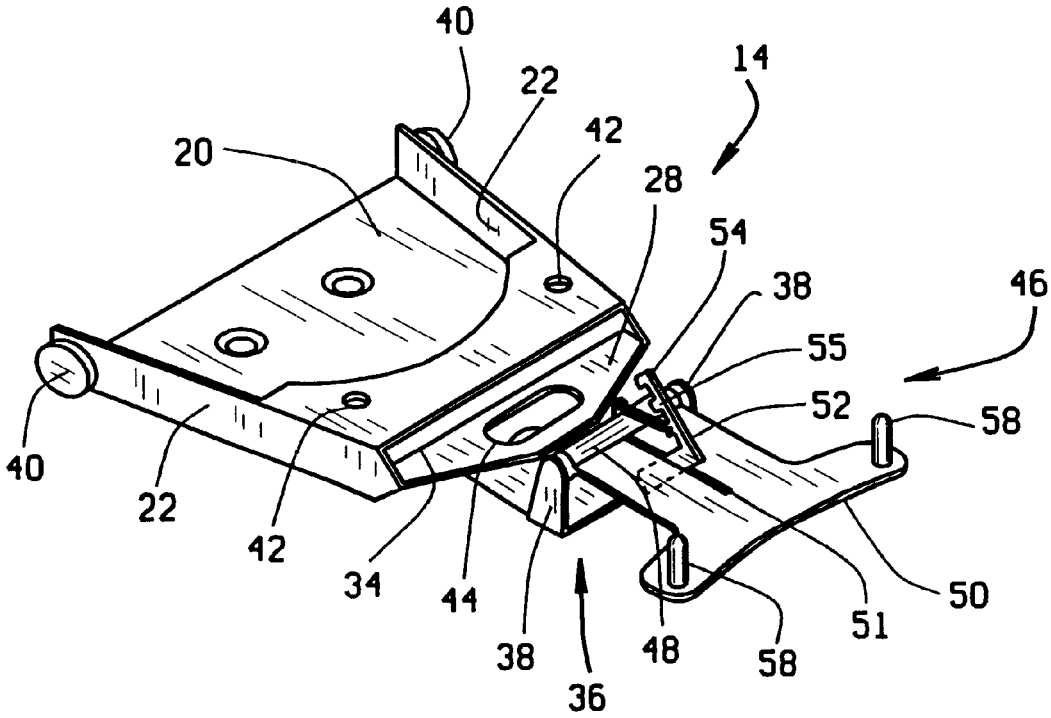
FIG. 4 is a perspective view of the toe member according to the present invention.
Figure 12:
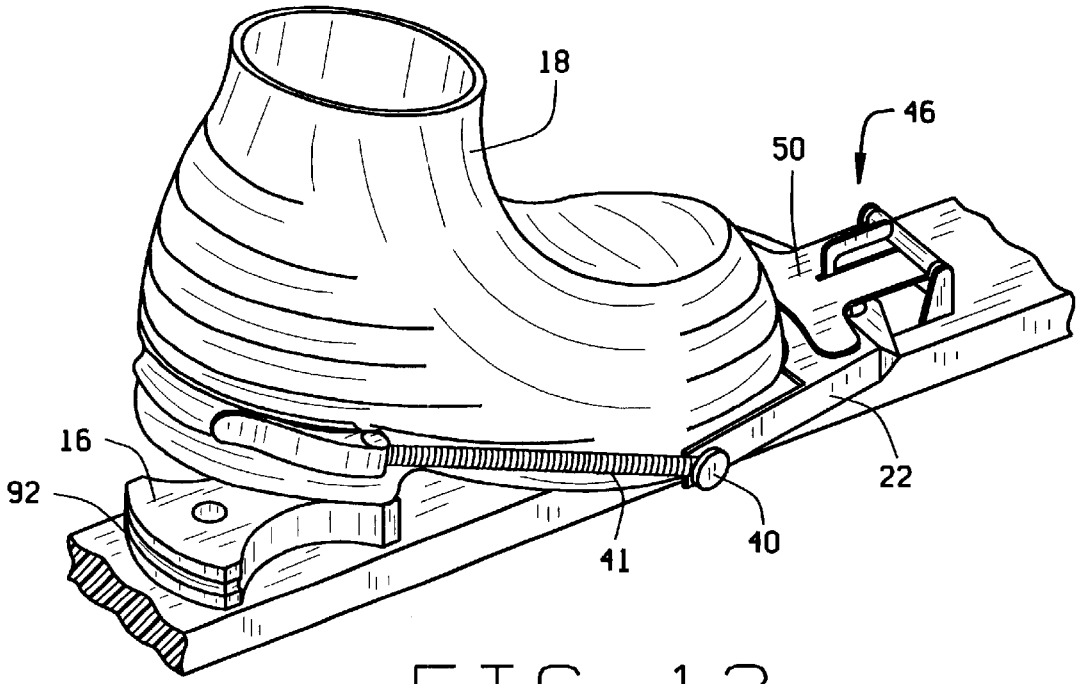
FIG. 12 is a perspective view of the ski binding assembly with a cable coupled to the ski boot according to the present invention.
Figure 13:
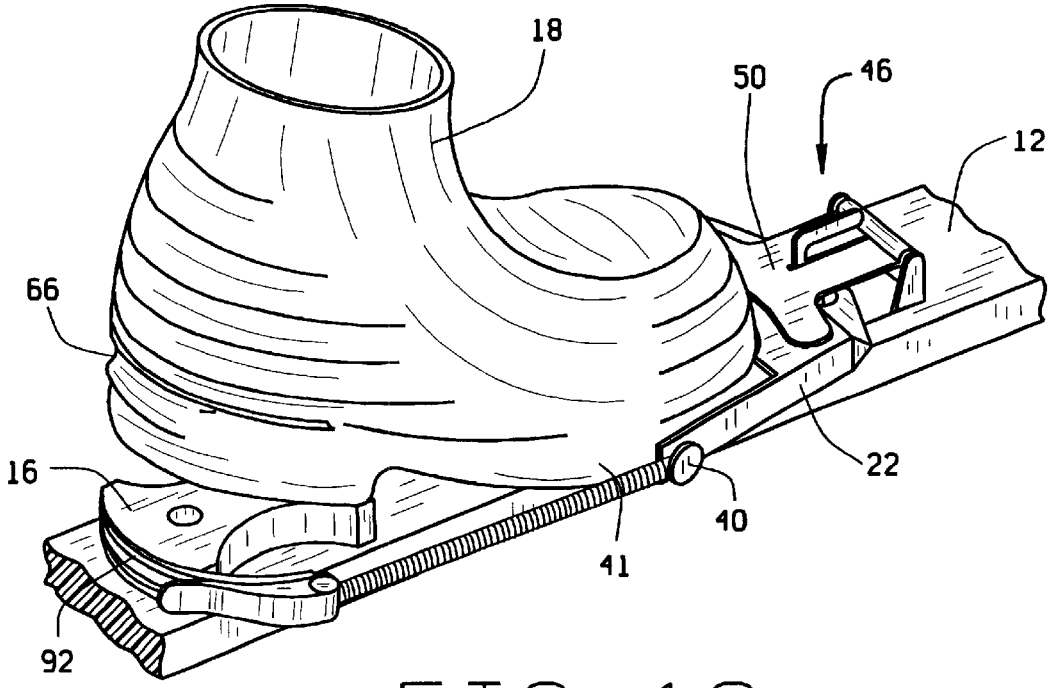
FIG. 13 is a perspective view of the ski binding assembly with the cable coupled to the heel member according to the present invention.
Figure 14:
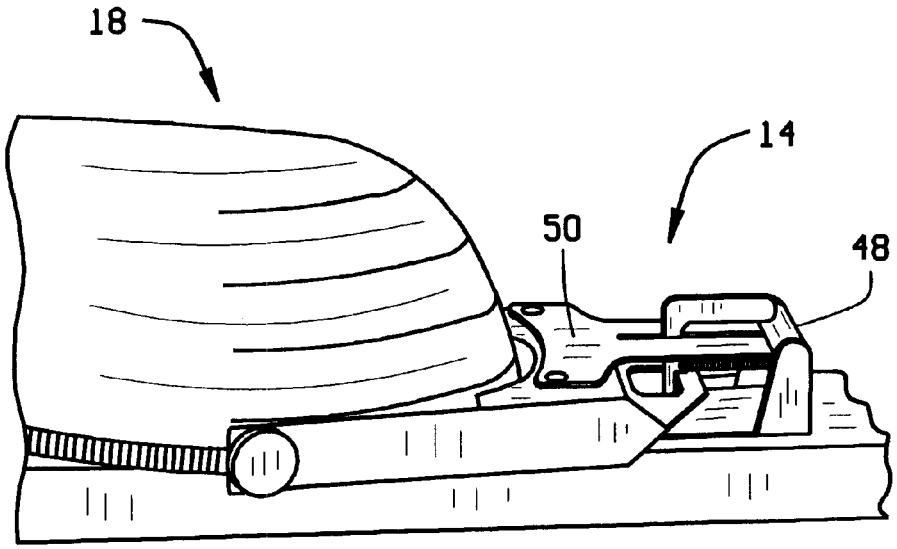
FIG. 14 is a fragmentary perspective view of the ski binding assembly having a disengagible latch in an engaged position according to the present invention.

With reference to FIGS. 3 and 4, front plate 28 defines a stop surface 34 within toe member 14. When inserted into toe member 14, ski boot 18 abuts stop surface 34 and the side walls 22, thereby providing a reliable indication to the skier when the ski boot 18 is properly aligned within toe member 14. Further, ski binding assembly 10 includes a cable 41. As shown in FIGS. 12 and 13, cable 41 is attached to a pair of knobs 40 formed on the side walls 41 of toe member 14. The cable 41 operates by drawing ski boot 18 securely against stop surface 34 and side walls 22. Since the forward motion of ski boot 18 is resisted by stop surface 34 (FIG. 4) and side walls 22, the possibility deforming ski boot 18 during use is greatly reduced.

Figure 6:
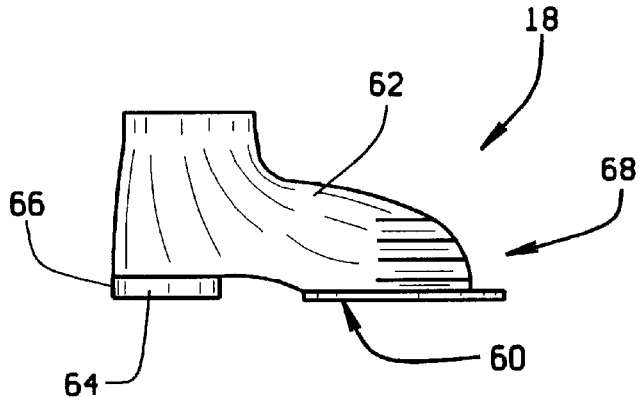
FIG. 6 is a side view of a ski boot of the ski binding assembly according to the present invention.
Figure 7:
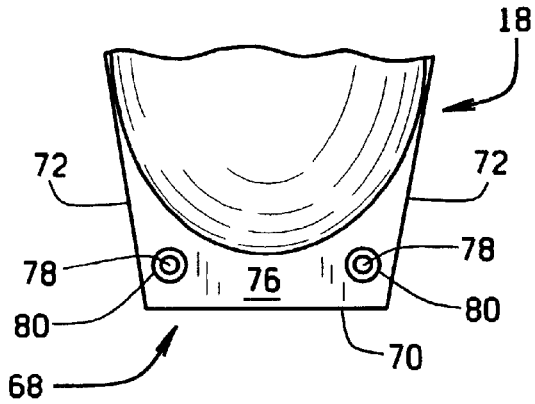
FIG. 7 is a fragmentary top plan view of the ski boot according to the present invention.
Figure 8:
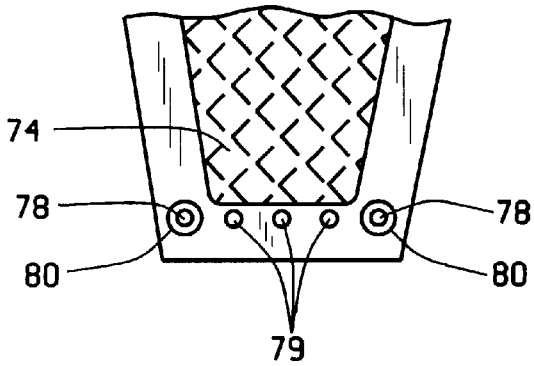
FIG. 8 is a fragmentary bottom plan view of the ski boot according to the present invention.

Referring to FIG. 6, ski boot 18 comprises a sole 60 and an upper 62. Sole 60 includes a heel 64 having a slot 66 for receipt of the cable 41 formed thereabout and a sole extension 68. In particular, sole extension 68 is defined by a front surface 70 and a pair of side surfaces 72, as shown in FIG. 7, which preferably correspond with the side walls 22 of toe member 14. Most preferably, the side surfaces 72 are inwardly tapered. Another novel aspect of ski boot 18 shown in FIGS. 7 and 8 is that sole extension 68 has a top surface 76 and a bottom surface 74 with through-holes 78 completely through the sole extension 68 from the top surface 76 to the bottom surface 74. Each through-hole 78 includes a liner 80. Preferably, liner 80 is formed from a resilient material, such as stainless steel and the like to minimize wear to the through-holes 78. Each of the through-holes 78 are sized to receive a corresponding one of projections 58 extending from latch plate 50 with projections 58 being located such that when ski boot 18 is inserted into toe member 14 with front surface 70 of the sole extension 68 abutting stop surface 34, each through-hole 78 is properly aligned with a respective aperture 42. Ski boot 18 also includes recesses 79 which are formed along the bottom surface of sole 60 for use with standard three-pin bindings.

Figure 5:
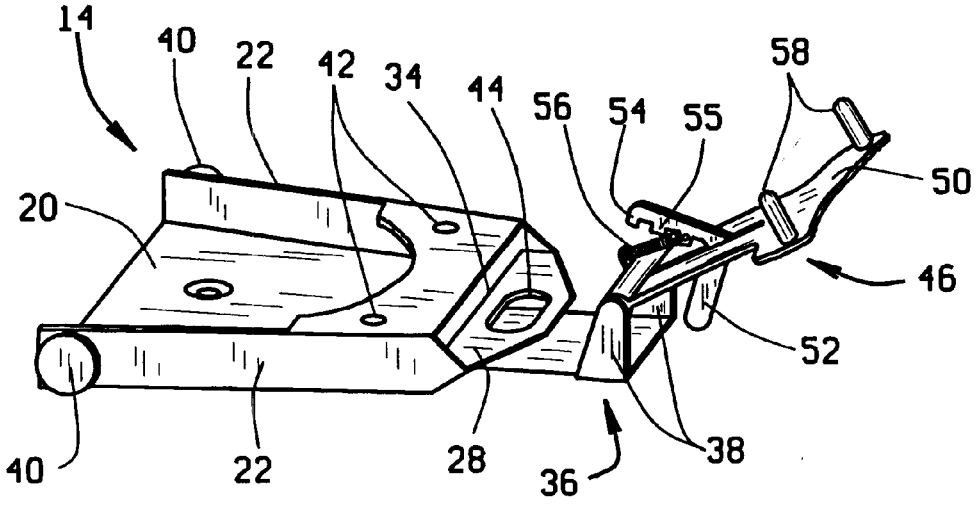
FIG. 5 is a side perspective view of the toe member according to the present invention.

The ski binding assembly 10 also includes a disengable latch 46 for securing ski boot 18 to ski 12 as illustrated in FIG. 4 and FIG. 5. The latch 46 includes a latch support 36 having a pair of upstanding arms 38 which extend from base plate 20. The disengagible latch 46 also includes a catch 44 formed through front plate 28 and a hinge 48 with a latch plate 50 secured thereto. Extending from the latch plate 50 are projections 58. Latch plate 50 may be pivoted about hinge 48. To secure latch plate 50 in an engaged position, disengagible latch 46 includes an L-shaped arm 52 with a first tooth 54 adapted to engage catch 44. The L-shaped arm 52 extends through a slit 51 in latch plate 50 and is biased by a biasing means, such as a spring 56 to engage catch 44. In the engaged position, the first tooth 54 is engaged with catch 44 with the projections 58 inserted into apertures 42, as shown in FIG. 4, thus clearing debris and snow from apertures 42. To secure latch 46 in a disengaged position, a second tooth 55 on the L-shaped arm 52 is engaged with catch 44. Finally, when none of the teeth 54, 55 are engaged with catch 44, the latch plate is freely pivotable. Of course one skilled in the art can best appreciate that disengagible latch 46 may be disengagably attached to the toe member 14 by a variety of other mechanisms well known in the art, such as by threading a screw through both the latch support 36 and top plate 24.

Figure 9:
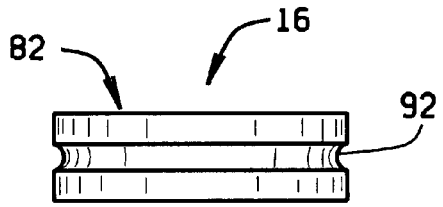
FIG. 9 is a rear view of a heel member of the ski binding assembly according to the present invention.
Figure 10:
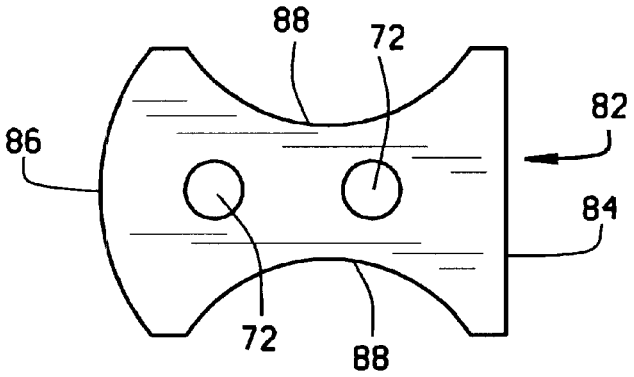
FIG. 10 is a top plan view of the heel member according to the present invention.
Figure 11:
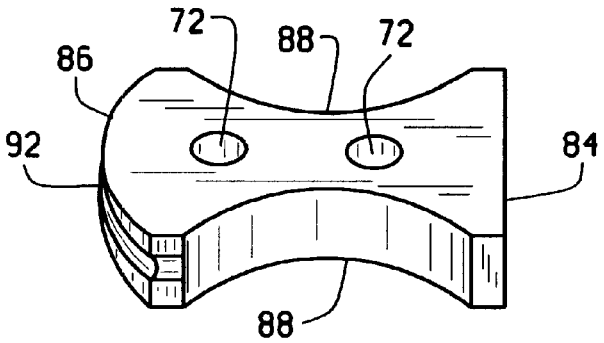
FIG. 11 is a side perspective view of the heel member according to the present invention.

Another novel feature of the present invention, as seen in FIGS. 9 and 10, is heel member 16 which supports the heel 64 of ski boot 18 while being constructed and configured to minimize the overall weight of the ski binding assembly 10. Heel member 16 includes a body 82 which is defined by a forward portion 84 and an opposing rearward portion 86 having a slot 92 formed thereabout. Body 82 is further defined by a pair of side portions 88. Preferably, side portions 88 are scalloped as shown in FIG. 10 so that body 82 has a generally hourglass shaped configuration to minimize material usage and corresponding weight of the heel member 16. Of course those skilled in the art can best appreciate that a variety of other configurations may be employed to reduce material usage while providing sufficient strength to support heel 64 of ski boot 18. Accordingly, the present invention contemplates that body 82 may have a generally I-shaped, C-shaped, or even O-shaped configuration, and the like. To secure heel member 16 to the ski 12, openings 72 are formed through heel member 16, as shown in FIG. 11, and are adapted to receive a screw or other similar attachment member in order to securely fasten heel member 16 to ski 12. Finally, rearward portion 86 of body 82 also includes a slot 92 for receipt of the cable 41 when not engaged in slot 66 of ski boot 18.

One skilled in the art can best appreciate that a variety of other devices may be utilized which would result in disengageable projections adapted to couple with sole 60 of a ski boot 18. For instance, the present invention contemplates the use of projections (not shown) that are spring biased to engage through-holes formed in the sole of a ski boot. Further, these projections may be disposed either above or below sole 60. As such, the projections may be spring biased in an upward direction throughholes if disposed below sole 60, or a downward direction if disposed above sole 60.

Figure 15:
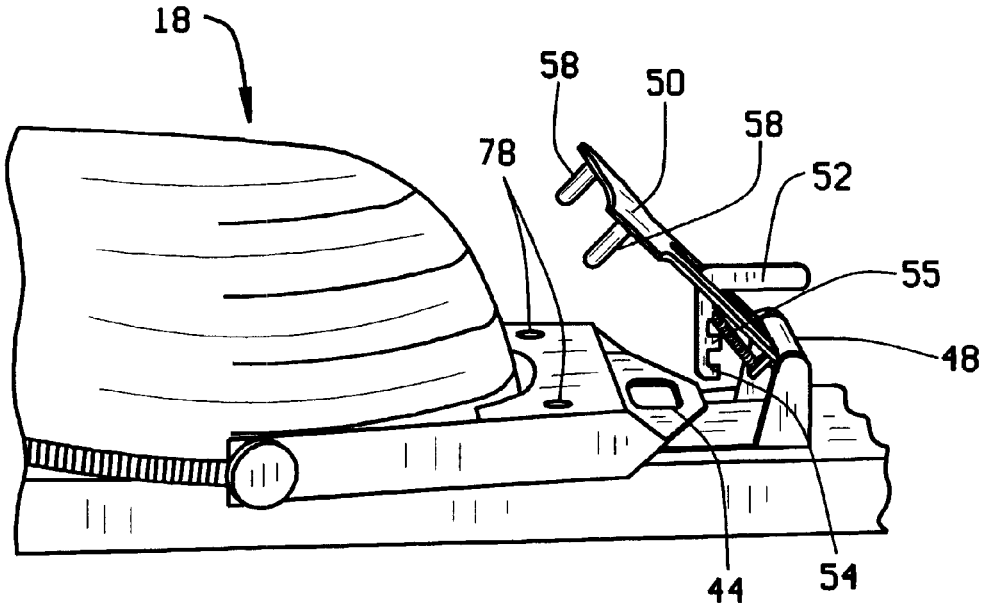
FIG. 15 is a fragmentary perspective view of the ski binding assembly having a disengagible latch in a disengaged position according to the present invention.
Figure 16:
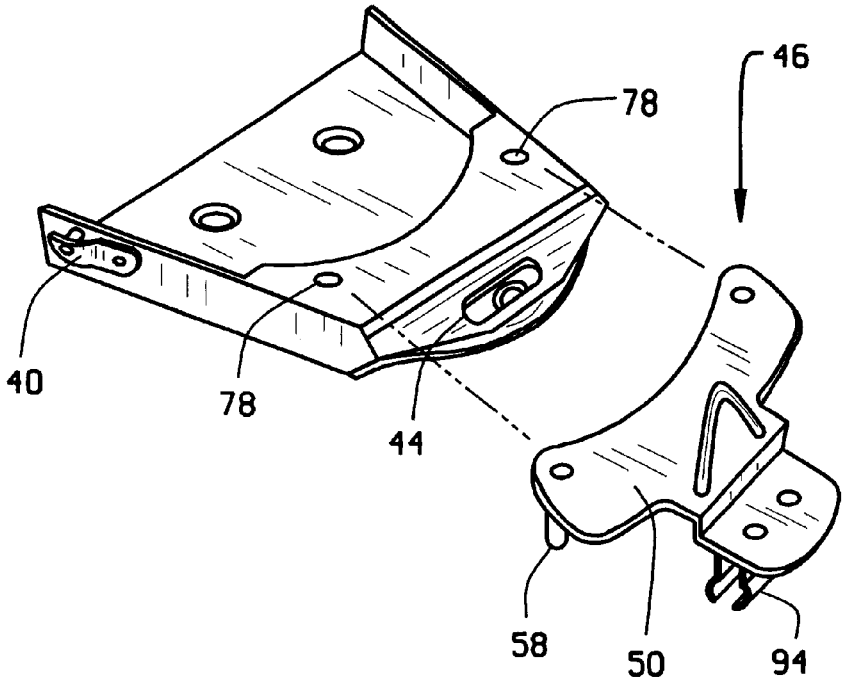
FIG. 16 is an exploded perspective of an alternative embodiment of the toe member.
Figure 17:
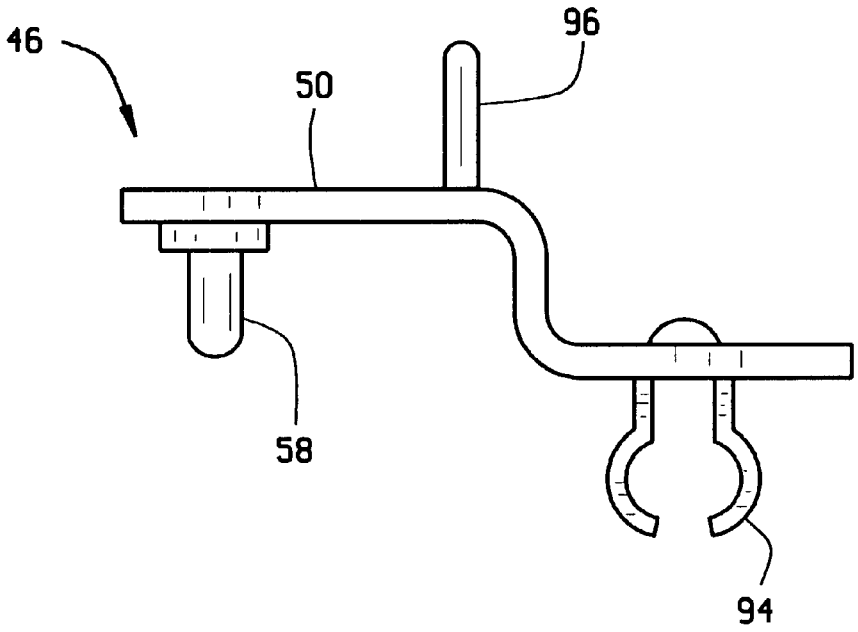
FIG. 17 is a side elevational view of an alternative embodiment of the disengagible latch.

In an alternative embodiment as shown in FIGS. 15 and 16, disengagible latch 46 comprises a latch plate 50 having projections 58 which extend therefrom. Once again, the latch plate 50 is disengagably connected to the toe member 14. However, rather than being pivotally connected, the latch plate 50 is removably connected to the toe member 14 by a spring clip 94 which engages catch 44. To assist in permitting engagement and disengagement of the latch 46, the latch 46 includes a finger loop 96 for use by a skier.

In operation, the skier first slides ski boot 18 forward into toe member 14 which forces any snow or other debris out of toe member 14 through openings 30 until ski boot 18 abuts stop surface 34 and side walls 22 of toe member 14. Once ski boot 18 abuts stop surface 34 and side walls 22, through-holes 78 are properly aligned with apertures 42 which may be visually verified by the skier looking at the apertures 42 to verify that the through-holes 78 are properly aligned with the apertures 42. One skilled in the art can best appreciate that this three-point abutment between the ski boot 18 and toe member 14 provides simpler alignment, better resistance to torsional forces, while reducing boot creep and through-hole wear. The ski boot 18 may be secured to the ski 12 with either the pin-type binding, cable-type binding, or both types of bindings at the option of the skier. To utilize the pin-type binding, ski boot 18 is secured to ski 12 by pivoting latch plate 50 about hinge 48 from a disengaged position to an engaged position. In the disengaged position, projections 58 are removed from through-holes 78, as illustrated in FIG. 15. Latch plate 50 may be secured in the disengaged position by capturing tooth 55 with catch 44. In the engaged position with tooth 54 captured by catch 44, projections 58 are received within through-holes 78. In the alternative embodiment, the skier simply presses the latch plate 50 down onto toe piece 14. As the latch plate 50 is pressed down and spring clip 94 engages with catch 44 to secure the latch plate in a engaged position. One skilled in the art can appreciate that the use of projections 58 which extend in a downward direction into the sole extension 68 enhances, visualization of the through-hole 78 and allows for snow or other debris which has collected within the through-holes 78 to be expelled as the projections 58 are inserted downwardly through apertures 42. Since through-holes 78 extend entirely through sole extension 68, projections 58 force any snow or other debris out of through-holes 78 as the projections 58 are forced into the top surface 76 towards bottom surface 74.

Referring to FIG. 15, when the skier decides to remove ski boot 18 from ski 12, the skier simply actuates L-shaped arm 52 such that both teeth 54 and 55 become disengaged from catch 44. The skier then pivots latch plate 50 about hinge 48 until projections 58 become disengaged from apertures 42. In order to secure latch plate 50 in a disengaged position, second tooth 55 is engaged with catch 44. To remove the latch plate 50 the skier simply pulls upward on finger loop 96 until the spring clip 94 clears catch 44. Referring back to FIG. 12, the cable type binding may be utilized by tensioning cable 41 about heel 64 such that cable 41 is received within slot 66 of the heel 64. However, as seen in FIG. 13, when the skier elects to use only the pin-type binding, the cable 41 may be secured to the heel member 16 by engaging cable 41 in slot 92 of heel member 16 while latch plate 50 is secured in an engaged position by engaging first tooth 54 with catch 44. Alternatively, the skier may utilize only the cable type binding. To do so, latch plate 50 may be secured in a disengaged position by engaging first tooth 54 with catch 44 while cable 41 is tensioned about heel 64.

It should be understood from the foregoing that while particular embodiments of the invention have been illustrated and described, various modifications can be made thereto without departing from the spirit and scope of the present invention.

We claim:

1. A ski binding assembly for attaching a ski boot to a ski, said ski binding assembly comprising:

a toe member having a forward end and a rearward end, said toe member attaching to a ski and including:

a base plate;

a top plate, distanced from said base plate, said top plate further including an aperture extending therethrough; and side walls connecting said top plate to said base plate and defining a hollow cavity between said base plate and said top plate such that said toe member includes an opening at said forward end, said rearward end and all points therebetween; and a front plate dividing said opening at said forward end of said toe member into at least two openings; and a latching member including a pin, the latching member movable between an engaged state wherein said pin extends through said aperture in said top plate and extends into a through-hole of a ski-boot, and a disengaged state wherein said pin is disengaged from said aperture and said through-hole.

2. The ski binding assembly of claim 1 wherein said front plate includes a stop surface to which said ski boot abuts when said latching member is in said engaged state.

3. The ski binding assembly of claim 2 wherein said stop surface abuts a sole extension on said ski boot.

4. The ski binding assembly of claim 1 wherein said base plate has a substantially planar surface.

5. The ski binding assembly of claim 1 wherein said base plate comprises stainless steel.

6. The ski binding assembly of claim 1 wherein said base plate includes at least one of texturing and knurling.

7. The ski binding assembly of claim 1 wherein said latching member is pivotably attached to said toe member.

8. The ski binding assembly of claim 7 wherein said latching member includes a biasing member.

9. The ski binding assembly of claim 1 wherein said latching member is removably attached to said toe member.

10. The ski binding assembly of claim 9 wherein said latching member includes a spring clip, and said toe member includes a catch for said spring clip.

11. The ski binding assembly of claim 1 wherein said toe member further includes attachment points for a cable, and a cable attached thereto.

12. The ski binding assembly of claim 11, further including a heel member attaching to said ski, said heel member including a rearward portion having a slot thereabout for the receipt of said cable.

13. The ski binding assembly of claim 1 wherein said base plate, said front plate, and said top plate are generally parallel.

14. A ski binding assembly comprising:

a ski boot having a sole extension and a heel, said sole extension including a through-hole extending through said sole extension and said heel including a cable groove;

a toe member including a base plate attached to a ski;

a top plate, distanced from said base plate, said top plate further including an aperture extending therethrough; and side walls connecting said top plate to said base plate and defining a hollow cavity between said base plate and said top plate such that said toe member includes an opening at a forward end, a rearward end and all points therebetween;

a front plate, dividing said opening at said forward end of said toe member into at least two openings;

a latch member including a protrusion for securing said ski boot to said toe member by placing said protrusion in a downward direction through said aperture in said toe member and into said through-hole in said ski boot.

a heel member attached to a ski rearward of said toe member; said heel member including a front portion; and a rear portion oppositely disposed relative to said front portion and with a cable slot formed thereon.

15. The ski binding assembly of claim 14 further comprising:

a pair of side portions transversely disposed relative to said front portion and said rear portion, at least one of said side portions being inwardly scalloped.

16. The ski binding assembly of claim 15 wherein both of said side portions are inwardly scalloped.

17. The ski binding assembly of claim 14 wherein said base plate, said front plate, and said top plate are generally parallel.

18. A ski binding comprising:

a toe member having a base plate;

a top plate, distanced from said base plate;

side walls connecting said top plate to said base plate and defining a hollow cavity between said base plate and said top plate such that said toe member includes an opening at a forward end, a rearward end and all points therebetween; and a front plate dividing said opening at said forward end of said toe member into at least two openings;

wherein said base plate, said front plate, and said top plate are generally parallel.

19. The ski binding of claim 18 wherein a ski boot is placed within said ski binding by the placing of a sole extension attached to said ski boot into said opening at said rearward end and sliding said ski boot forward until said sole extension is in contact with said front plate.

20. The ski binding of claim 19 wherein said ski boot is attached to said ski binding by a latching member having at least one pin, said pin extending downward through an aperture in said top plate and into a through-hole in said sole extension after said ski boot is placed in said ski binding.

21. The ski binding of claim 19 wherein particles of matter within said hollow cavity are ejected out at least one of said forward openings by the placement of said ski boot in said ski binding.

22. The ski binding of claim 21 wherein said particles of matter include snow.

* * * * *